US006219012B1

(12) United States Patent
Holtslag

(10) Patent No.: US 6,219,012 B1
(45) Date of Patent: Apr. 17, 2001

(54) FLAT PANEL DISPLAY APPARATUS AND METHOD OF DRIVING SUCH PANEL

(75) Inventor: Antonius H. M. Holtslag, Eindhoven (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/180,159

(22) PCT Filed: Dec. 15, 1997

(86) PCT No.: PCT/IB97/01567

§ 371 Date: Nov. 3, 1998

§ 102(e) Date: Nov. 3, 1998

(87) PCT Pub. No.: WO98/39763

PCT Pub. Date: Sep. 11, 1998

(30) Foreign Application Priority Data

Mar. 7, 1997 (EP) ..... 97200691

(51) Int. Cl.[7] ..... G09G 3/28

(52) U.S. Cl. ..... 345/60; 345/63; 345/67; 345/68

(58) Field of Search ..... 345/60, 63, 66–68

(56) References Cited

U.S. PATENT DOCUMENTS 5,420,602 * 5/1995 Kanazawa ..... 345/67
5,436,634 * 7/1995 Kanazawa ..... 345/60
5,541,618 7/1996 Shinoda ..... 345/60
5,654,728 * 8/1997 Kanazawa ..... 345/68
5,835,072 * 10/1998 Kanazawa ..... 345/68
5,841,413 * 10/1998 Zhu et al. ..... 345/67
5,874,932 * 2/1999 Nagaoka et al. ..... 345/63
5,943,030 * 8/1999 Minamibayashi ..... 345/60

FOREIGN PATENT DOCUMENTS

0549275B1 5/1997 (EP) ..... G09G/3/28

* cited by examiner

*Primary Examiner*—Richard Hjerpe
*Assistant Examiner*—Duc Dinh

(57) ABSTRACT

A flat panel display comprises a plurality of display elements (C) arranged in a matrix of rows (R) and columns, and first and second electrodes (Sc, Su) which are aligned with respect to each other and extend in a row or a column direction. The first and second electrodes (Sc, Su) form pairs which are associated with same display elements (C). An amount of electro-magnetical interference caused by currents through the first and second electrodes (Sc, Su) is decreased by driving the first and second electrodes (Sc, Su) in at least two groups such that the pairs are divided in two groups, and such that currents in pairs belonging to different groups flow in opposite directions.

5 Claims, 5 Drawing Sheets

FLAT PANEL DISPLAY APPARATUS AND METHOD OF DRIVING SUCH PANEL

Figure 1:
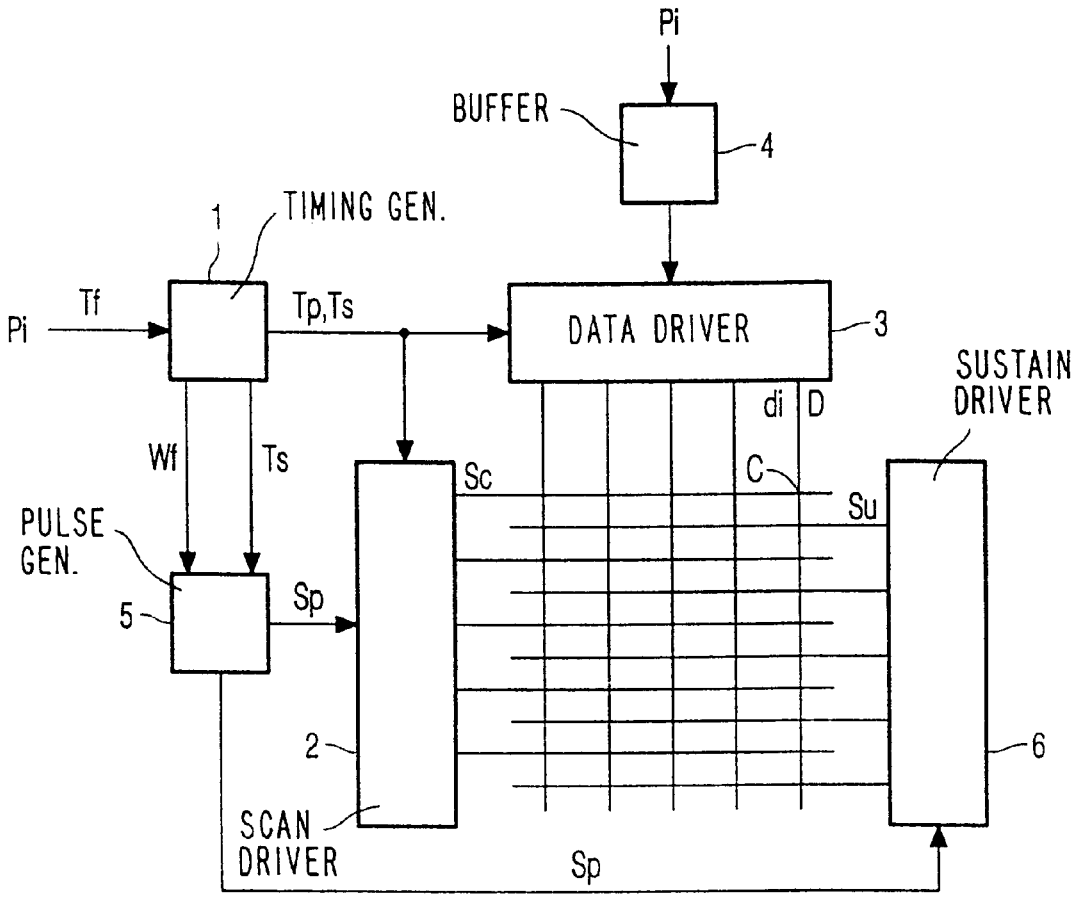
FIG. 1 PRIOR ART

The invention relates to a flat panel display apparatus, and a method and apparatus for minimizing EMI radiations from the flat panel display.

Prior art U.S. Pat No. 5,541,618 discloses sub field driven flat panel displays. An embodiment describes a surface discharge type plasma display panel (further referred to as PDP). A plurality of X-electrodes each arranged parallel and close to a plurality of Y-electrodes, and address electrodes orthogonal to the X and Y electrodes are arranged on a surface of a panel. Electrodes crossing each other are insulated with an insulating layer. An address cell is formed at each crossing of the Y-electrodes and the address electrodes. Display cells are formed between the Y-electrode and the adjacent X-electrode, close to the corresponding address cells, respectively. An address period is performed concurrently on all the Y-electrodes. In address periods, a write pulse is applied to all the X-electrodes while a first sustain pulse that is opposite to the write pulse is applied to all the Y-electrodes, and the address electrodes are kept at zero volts. Accordingly, all the display cells are discharged. Next, immediately subsequent to the write pulse a second sustain pulse opposite to the write pulse is applied to all the X-electrodes, so that a wall charge is generated in each display cell and a part of the associated address cell. Next, an erase pulse is applied sequentially to each of the Y-electrodes. Concurrently to the application of the erase pulse, an address pulse is selectively applied to an address electrode of a display cell not to be lit later during the subsequent display period by erasing a wall charge. At a cell to which no address pulse is applied, the wall charge is maintained and the cell will lit during the subsequent display period.

In a first display period subsequent to the first address period, sustain pulses are applied to all the cells by applying first sustain pulses to all the Y-electrodes and second sustain pulses alternately to all X-electrodes. The cells with a wall charge are lit by the sustain pulses.

If the flat panel display is driven in a sub field mode, the above mentioned operations are repeated in the subsequent sub fields.

It is a drawback of the flat panel display apparatus of the prior art that it generates a high amount of electro-magnetic interference (further referred to as EMI).

It is an object of the invention to provide a flat panel display apparatus and a method for driving such an apparatus generating less EMI.

To this end, the invention provides a method and apparatus for driving a flat panel display that drives two complementary sets of pairs of electrodes in the flat panel display with opposing currents.

A pair of scan and sustain electrodes (in the prior art referred to as X and Y electrodes, in the claims referred to as first and second electrodes) is associated with each display cell (also referred to as display element). A display cell may be a portion of a plasma channel at the intersection of the a pair of scan and sustain electrodes and an address electrode (further referred to as data electrode). The plasma channel may be aligned with the data electrodes or with the scan and sustain electrodes. The scan and sustain electrodes each are divided in at least two groups such that the pairs of scan and sustain electrodes are divided in at least two groups. Drive signals are supplied to the groups of scan and sustain electrodes such that the currents in the pairs of scan and sustain electrodes belonging to different groups flow in opposite direction. The EMI generated due to the currents in a certain pair of scan and sustain electrodes is almost canceled by the EMI generated due to the currents flowing in the opposite direction in a nearby situated pair of scan and sustain electrodes belonging to a different group. Consequently, the total amount of EMI decreases.

In the prior art all pairs of scan and sustain electrodes are driven in a same way. Consequently, all currents in the scan and sustain electrodes have a same direction. This causes a high amount of EMI, especially during the display period (also referred to as sustain period) during which all scan and sustain electrodes are driven at the same time.

In first embodiment of the invention, the drive circuit for driving the sustain electrodes is very simple as it consists of conductors interconnecting the sustain electrodes in groups.

In a another embodiment of the invention, pairs of scan and sustain electrodes belonging to different groups alternate. In this way, a maximum compensation of the EMI generated by the two consecutive pairs is obtained, because a minimal area between successive pairs with opposite currents adds to the EMI, and a maximum correlation between the signals on the rows exist.

These and other aspects of the invention will be apparent from and elucidated with reference to the accompanying drawings.

Figure 2:
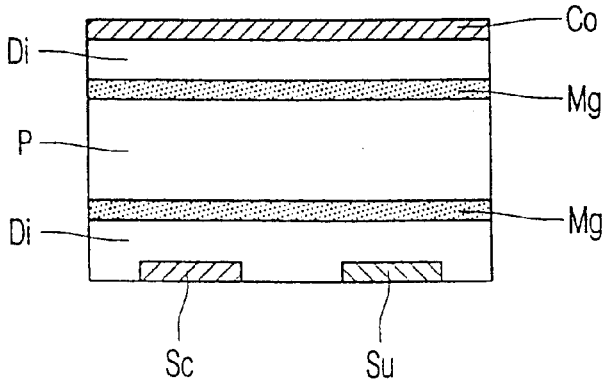
FIG. 2 PRIOR ART
Figure 3:
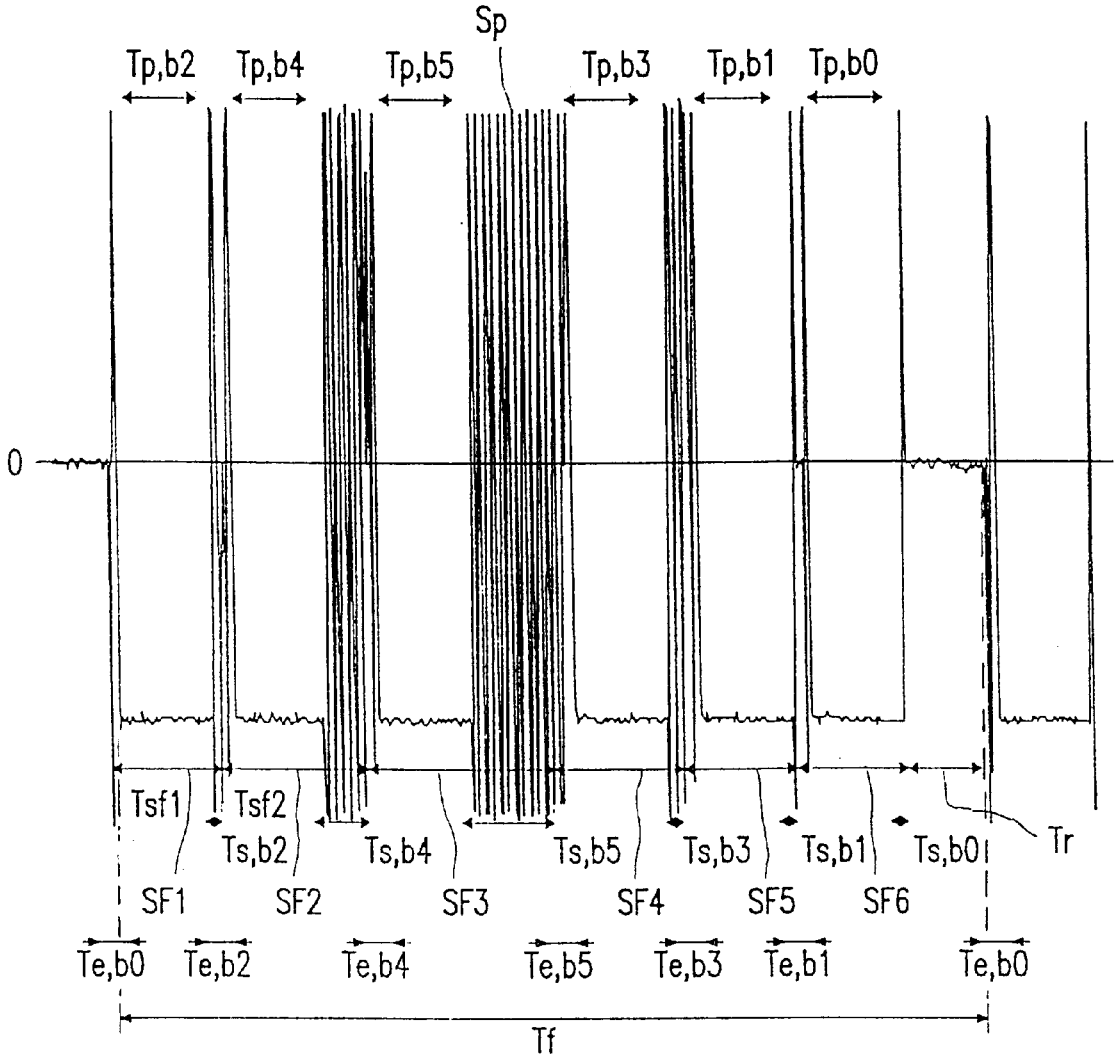
FIG. 3 PRIOR ART
Figure 4A:
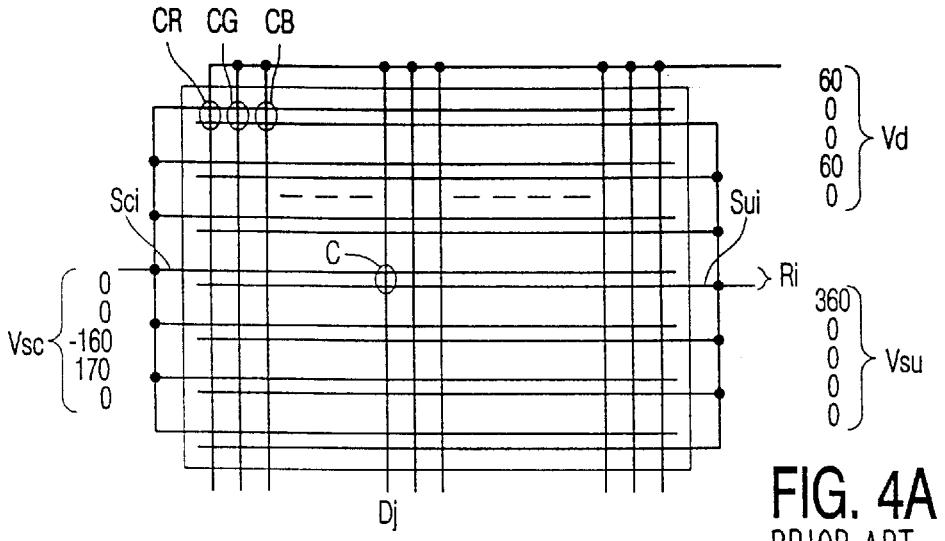
FIG. 4A PRIOR ART
Figure 4B:
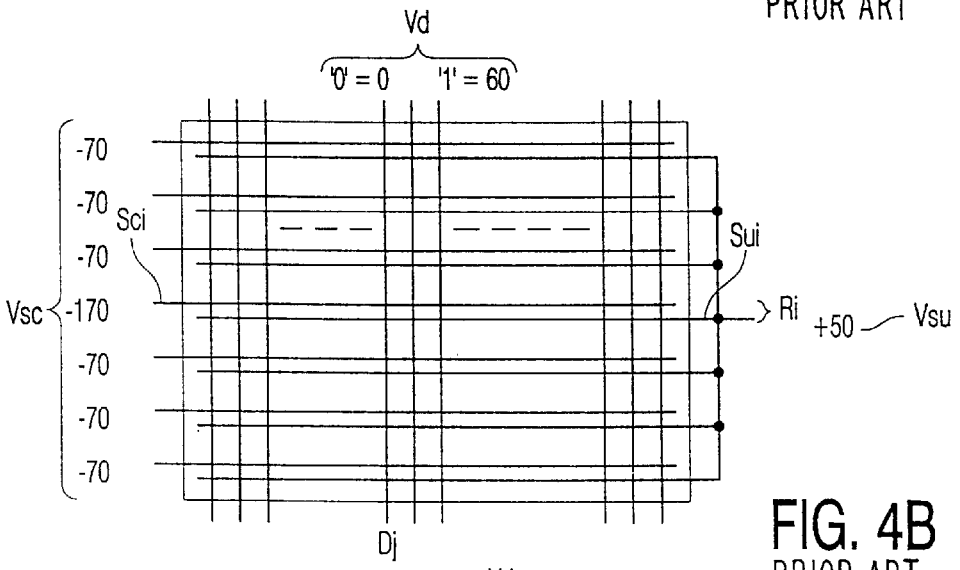
FIG. 4B PRIOR ART
Figure 4C:
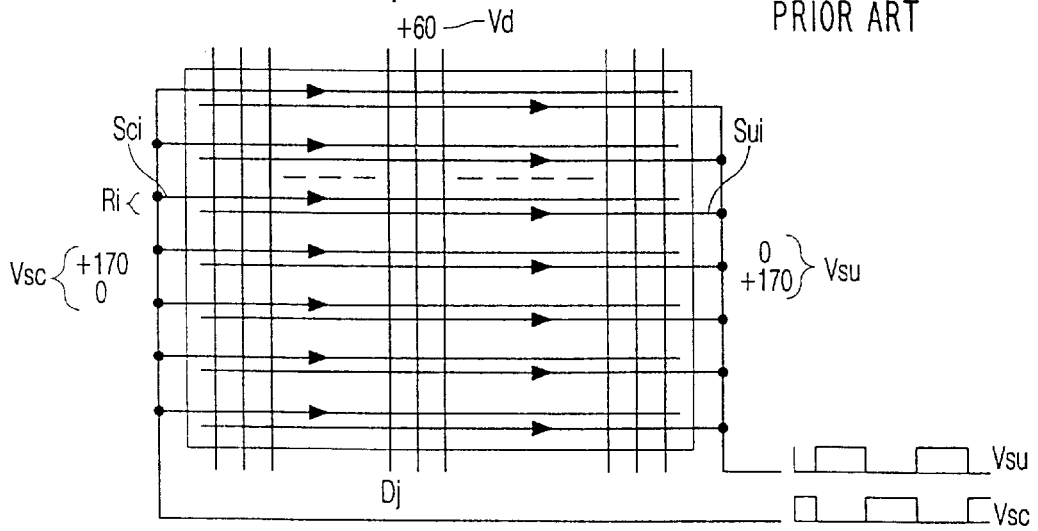
FIG. 4C PRIOR ART
Figure 5:
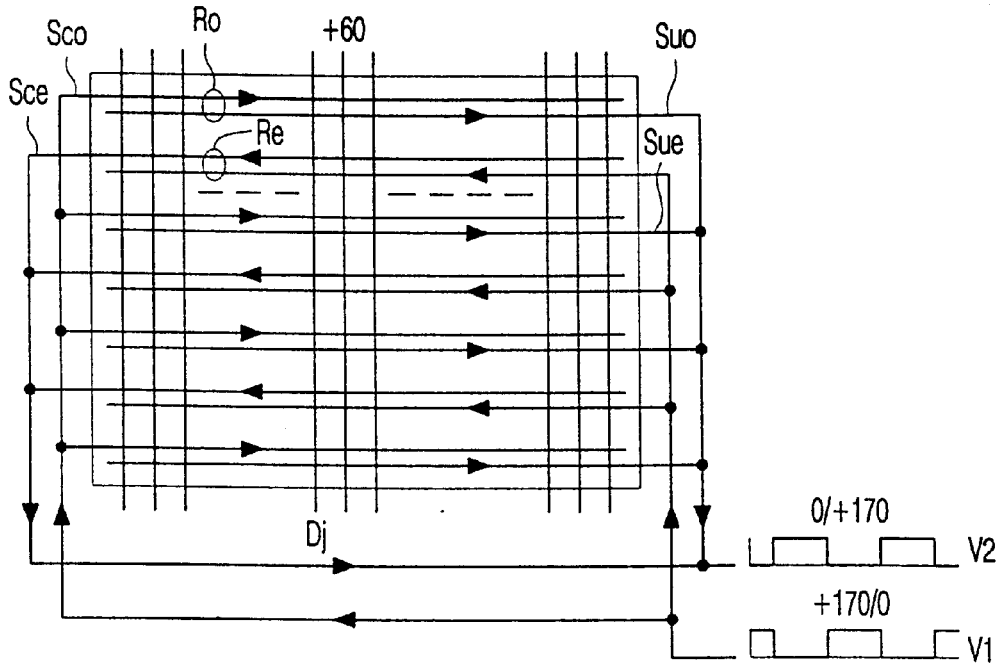
Figure 6:
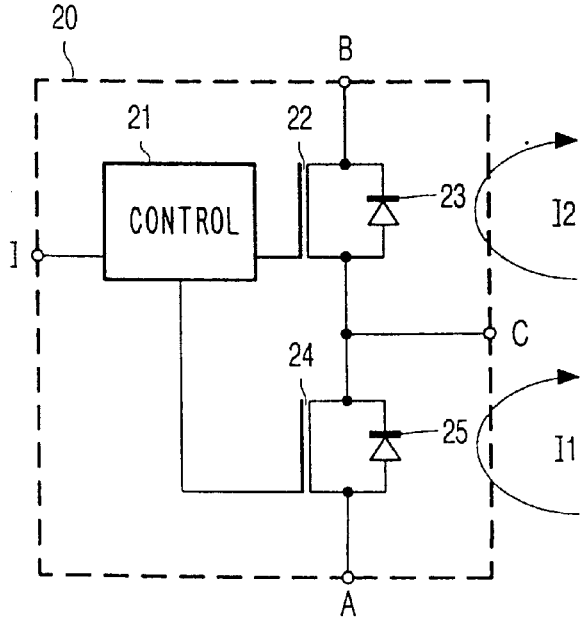
Figure 7:
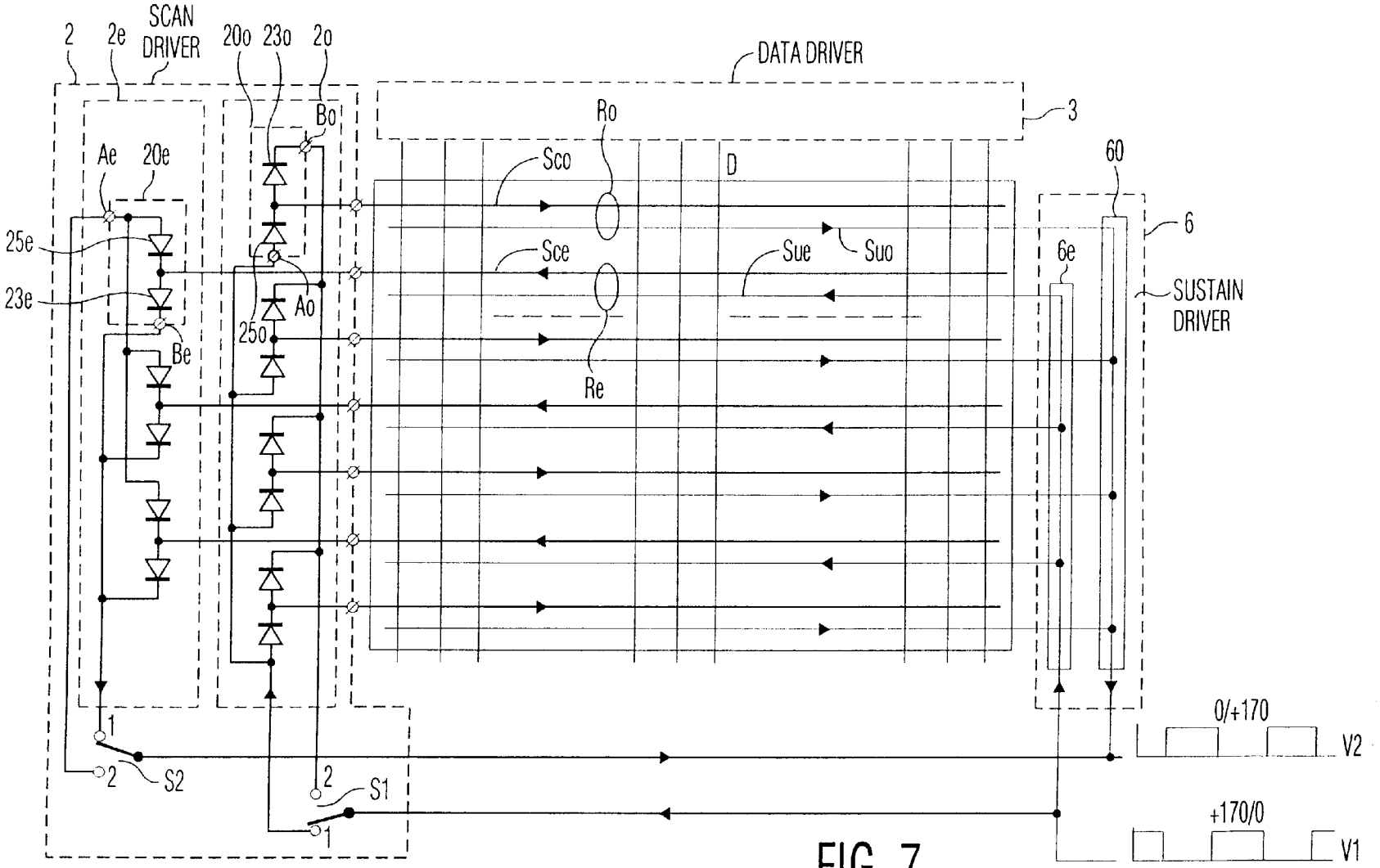

In the drawings:

FIG. 1 schematically illustrates a circuit for driving a PDP of a surface-discharge type in a sub field mode as known from the prior art, FIG. 2 schematically illustrates a basic sub-pixel structure of a surface-discharge type PDP, FIG. 3 shows voltage waveforms between a scan and a sustain electrode of the prior art surface-discharge type PDP, FIGS. 4A, 4B, and 4C show voltages supplied to the scan and the sustain electrodes during an erase period, a prime period and a sustain period, FIG. 5 shows the voltages supplied to the groups of scan and sustain electrodes according to an embodiment of the invention, FIG. 6 shows a basic sub-circuit of the scan driver circuit, and FIG. 7 shows the connections of sub-circuits during a sustain period according to an embodiment of the invention.

FIG. 1 schematically illustrates a circuit for driving a PDP of a surface-discharge type in a sub field mode as known from the prior art. Two glass panels (not shown) are arranged opposite to each other. Data electrodes D are arranged on one of the glass panels. Pairs of scan electrodes Sc and sustain electrodes Su are arranged on the other glass panel. The scan electrodes Sc are aligned with the sustain electrodes Su, and the pairs of scan and sustain electrodes Sc, Su are perpendicular with respect to the data electrodes D. Display elements (for example plasma cells) C are formed at the cross points of the data electrodes D and the pairs of scan and sustain electrodes Sc, Su. A timing generator 1 receives display information Pi to be displayed on the PDP. The timing generator 1 divides a field period Tf of the display information Pi into a predetermined number of consecutive sub field periods Tsf (see FIG. 3). A sub field period Tsf comprises an address period or prime period Tp and a display period or sustain period Ts. During an address period Tp, a scan driver 2 supplies pulses to the scan electrodes Sc for successively selecting the scan electrodes Sc one by one, and a data driver 3 supplies data di to the data electrodes D to write the data di to the display elements C associated with the selected scan electrode Sc. In this way the display elements C associated with the selected scan electrode Sc are preconditioned. A sustain driver 6 drives the sustain electrodes Su. During an address period Tp, the sustain driver 6 supplies a fixed potential. During a display period Ts, a sustain pulse generator 5 generates sustain pulses Sp which are supplied to the display elements C via the scan driver 2 and the sustain driver 6. The display elements C, which are preconditioned during the address period Tp to produce light during the display period Ts, produce an amount of light depending on a number or a frequency of the sustain pulses Sp. It is also possible to supply the sustain pulses Sp to either the scan driver 2 or the sustain driver 6. It is also possible to supply the sustain pulses Sp to the data driver 3 or both to the scan driver 2 or the sustain driver 6 and the data driver 3.

The timing generator 1 further associates a fixed order of weight factors Wf to the sub field periods Sf in every field period Tf. The sustain pulse generator 5 is coupled to the timing generator 1 to supply a number or a frequency of the sustain pulses Sp in conformance with the weight factors Wf such that an amount of light generated by a preconditioned display element C corresponds to the weight factor Wf. A sub field data generator 4 performs an operation on the display information Pi such that the data di is in conformance with the weight factors Wf.

Such a PDP and the operation thereof in a sub field mode are described in detail in U.S. Pat. No. 5,541,618 or in EP-B-0,549,275.

FIG. 2 schematically illustrates a basic AC plasma sub-pixel of a surface-discharge type PDP. The plasma sub-pixel or display element C is associated to phosphor emitting one of the three primary colors. The plasma sub-pixel C is formed by the crossing of two row electrodes Sc, Su and a column electrode Co. The two row electrodes Sc, Su are situated at the bottom of the sub-pixel and are referred to as scan electrode Sc and sustain electrode Su. The column electrode Co is situated on top of the sub pixel and is referred to as data electrode D. Plasma P is arranged between the column electrode Co and the two row electrodes Sc, Su via respective dielectric layers Di. The plasma P is insulated from the dielectric layers Di by MgO layers Mg. When regarding a complete panel, the sustain electrodes Su are interconnected for all rows of the PDP panel. The scan electrodes Sc are connected to row IC's and scanned during the addressing or priming phase. The column electrodes Co are operated by column IC's. The plasma cells C are operated in three modes:

1) The Erase mode. Before each sub-field is primed, all plasma cells C are erased together at the same time. This is done by first driving the plasma cells C into a conducting state and then removing all charge built up in the cells C.

2) Prime mode. Plasma cells C are conditioned such that they will be in an on or off state during sustain mode. Since a plasma cell C can only be fully on or off, several prime phases are required to write all bits of a luminance value. Plasma cells C are selected on a row-at-a-time basis and the voltage levels on the columns Co will determine the on/off condition of the cells. If a luminance value is represented in 6 bits, then also 6 sub-fields are defined within a field.

3) Sustain mode. An alternating voltage is applied to scan and sustain electrodes Sc, Su of all rows together at the same time. The column voltage is mainly at a high voltage potential. The plasma cells C primed to be in the on state, will light up. The weight of an individual luminance bit will determine the number of light pulses during sustain. When the power dissipation of the panel is too high, the number of sustain pulses in each sub-field is shortened to the same extent (so less sustain pulses are actually generated) thereby reducing the panel's light output and power dissipation.

FIG. 3 shows voltage waveforms between scan electrodes Sc and sustain electrodes Su of the known surface-discharge type PDP. Since there are three modes, the corresponding time sequence is indicated as Te,bx (erase mode for bit-x subfield), Tp,bx (prime mode for bit-x subfield SFi) and Ts,bx (sustain mode for bit-x subfield SFi. The number of sustain pulses will vary in time to time limit the power dissipation so a residual time Tr is taken into account to match the field frequency again.

FIG. 4 shows result of a measurement of the differential voltage between a scan and the common sustain electrodes Sc, Su when this voltage is measured over a field.

FIG. 4 only gives a rough indication of what happens in a field period Tf.

Prime and erase sequences in each subfield SFi are the same. The duration of the sustain sequence depends on the weight of the individual bits and contains a number of alternating pulses with the same frequency. When the power dissipation of the panel is too high, the number of alternating pulses during sustain time Ts,bx will be less. This results in shorter sustain periods Ts,bx in the sub-fields SFi and the residual time $T_r$ will increase to match the field frequency.

TABLE 1

Timing in erase, prime and sustain modes.

| | bit-5[μs] | bit-4[μs] | bit-3[μs] | bit-2[μs] | bit-1[μs] | bit-0[μs] |
|---|---|---|---|---|---|---|
| Tp. black | | | 6 × 1800 | | | |
| Ts. black | 1737 [179c] | 854 [87c] | 432[43c] | 221[21c] | 115[l0c] | 57[4c] |
| Te. black | | | 6 × 168 | | | |
| Tr. black | | | 1 × 1443 | | | |
| Tp. white | | | 6 × 1800 | | | |
| Ts. white | 1017 [104c] | 499 [50c] | 259[25c] | 125[llc] | 67[5c] | 38[2c] |
| Te. white | | | 6 × 168 | | | |
| Tr. white | | | 1 × 2854 | | | |

Table 1 gives an overview of the panel's timing when an over-all black (level 0) or white (level 63) picture is displayed. As can be seen from the table, the prime and erase modes are not changed when the power dissipation is limited by the electronics. The number of sustain pulses is roughly halved when a complete white picture is displayed. The number of sustain pulses is also given in the table (pulse count can be found between brackets in the Ts-rows). Equation 1 can be used to calculated the sustain time Ts,bx in a subfield SFi.

$$Ts,bx=T_{sustain}=19+9.6.N\ [\mu s] \quad \text{(Equation 1)}$$

The variable N stands for pulse count, printed in the table. Each pulse takes 9.6 μs and N pulses are always preceded by a specified sequence of 19 μs.

FIGS. 4A, 4B, and 4C show voltages supplied to the scan and the sustain electrodes Sc, Su during an erase period Te, a prime period Tp and a sustain period Ts, respectively. In the AC plasma display panel shown in FIGS. 4A, 4B, and 4C, each plasma cell C (further referred to as cell) is addressed with two row electrodes (the scan and the sustain electrodes Sci, Sui) and one column electrode (the data electrode Dj). A VGA display may consists of 480*(3*852) cells C. The number of rows Ri is 480, the number of pixels in a row is 852, and a pixel consists of three adjacent cells CR, CG, CB, one for each of the three primary colors.

FIG. 4A shows voltages applied to the electrodes Sc, Su, D during the erase period Te. A sequence of scan voltages Vsc applied to the scan electrodes Sc is denoted by five numbers arranged in a column at the left side of the plasma panel. The five numbers correspond to five consecutive sub periods of the erase period Te. The first number of the column denotes the value of the scan voltage Vsc during a first sub period of the erase period Te, the fifth number in the column denotes the value of the scan voltage Vsc during the last sub period of the erase period Te. All scan electrodes Sc are interconnected. A sequence of sustain voltages Vsu applied to the sustain electrodes Su is denoted at the right side of the plasma panel. All sustain electrodes Su are interconnected. A sequence of data voltages Vd applied to the data electrodes D is denoted at the right side of the plasma panel. Voltage values which have a same vertical position in a column belong to a same sub period of the erase period Te. For example, during the third sub period of the erase period Te, the scan voltage Vsc is minus 160 volts, the sustain voltage Vsu is zero volts, and the data voltage is zero volts. After the erase period Te, all cells are erased.

FIG. 4B shows the scan voltage Vsc, the sustain voltage Vsu, and the data voltage Vd during a sub period of the prime period Tp. The scan voltage Vsc of the selected row Rs has a value of minus 170 volts. To all other rows Ri, a scan voltage Vsc of minus 70 volts is applied. All sustain electrodes Su are interconnected and receive a sustain voltage of 50 volts. The data voltage Vd has either a value of zero volts or 60 volts to precondition a cell C to stay dark or to emit light, respectively, during the subsequent sustain period Ts. During the prime period Tp all rows are selected subsequently to precondition all the cells C row by row. Only the primed cells C will ignite during the sustain period.

FIG. 4C shows the scan voltage Vsc, the sustain voltage Vsu, and the data voltage Vd during the sustain period Ts, as applied in the prior art. The scan voltage Vsc is applied to the scan electrodes Sc which are all interconnected. The sustain voltage Vsu is applied to the sustain electrodes Su which are all interconnected. The data electrodes D supply a data voltage Vd with a value of 60 volts. The sustain period Ts comprise sustain pulses Sp with a typical repetition time of about 20 us. A sustain pulse Sp comprises two consecutive periods, a first period during which the scan voltage Vsc is 170 volts and the sustain voltage Vsu is zero volts, and a second period during which the scan voltage Vsc is zero volts and the sustain voltage Vsu is 170 volts. During the sustain period Ts, large currents flow in the rows R of the PDP to create the light output. A maximum current of about 300 mA flows in each row R of a 42" PDP when a white line has to be displayed. Consequently, a total display peak current of 144 ampere with a frequency of about 50 kHz flows in a VGA display with 480 rows R if a white plane has to be displayed. This introduces a lot of EMI. Let us assume that the total return current is collected at the back of the PDP in the middle. So, the total current is supplied to, or withdrawn from the scan electrodes Sc via a scan conductor connected to the scan electrode Sc arranged in the middle of the PDP, and the total current is supplied to or withdrawn from the sustain electrodes Su via a sustain conductor connected to the sustain electrode Su arranged in the middle of the PDP. Both the scan and the sustain conductor end at the right side of the PDP near to each other. The area enclosed by the current loops is different for each row R. Let us assume that the area enclosed by one row R is indicated by Ar=Ap/480, wherein Ap is the area of the PDP and 480 is the numbers of rows of the PDP. The total area enclosed by the currents equals approximately:

$$Atotal=2*(1+2+\ldots+240)*Ar=57840\ Ar.$$

This total area Atotal is a measure for the amount of EMI generated by the PDP.

FIG. 5 shows the voltages supplied to the groups of scan and sustain electrodes Sc, Su during the sustain period Ts according to an embodiment of the invention. The scan electrodes Sc and the sustain electrodes Su both are divided in two groups. All scan electrodes Sco of odd rows Ro are interconnected to receive a first voltage V1, and all scan electrodes Sce of even rows are interconnected to receive a second voltage V2. All sustain electrodes Suo of the odd rows are interconnected to receive the second voltage V2, and all sustain electrodes Sue of the even rows are interconnected to receive the first voltage V1. Both the first voltage V1 and the second voltage V2 have alternately a value of zero and 170 volts. The first voltage V1 is zero volts if the second voltage V2 has a value of 170 volts, and the other way around. In this way, the currents flowing in the scan and sustain electrodes Sc, Su of successive rows R have opposite directions. The electromagnetic field generated by the current through a particular odd row Ro is almost compensated by the electro-magnetic field generated by a successive even row Re. Only the area between the odd and even row Ro, Re adds to the EMI. So, the area enclosed by the currents in a VGA PDP with 480 rows R is approximately 480*Ar. Consequently, with respect to the prior art a reduction in EMI is obtained of about 20*log(57840/480)= 42 dB. This calculation of the EMI reduction is based on a first order approximation, in a practical three-dimensional set-up a reduction of 20 to 25 dB has been measured.

An optimal reduction of the EMI is reached by generating opposite currents in successive rows R. In this way, a maximum compensation of the EMI generated by the two consecutive pairs is obtained, because a minimal area between successive pairs with opposite currents adds to the EMI, and a maximum correlation between the display signals on the rows exist.

It is also possible to reduce the EMI if the PDP is divided in blocks of n (for example 16) successive rows R in which the current flows in a same direction followed by a block of successive rows R in which the current flows in a direction opposite to the current direction of the preceding block of successive rows R.

FIG. 6 shows a basic sub-circuit 20 of the scan driver circuit 2. The basic sub-circuit 20 of FIG. 6 comprises a first field effect transistor (FET) 22 with a main current path arranged in series with a main current path of a second FET 24. First and second diodes 23, 25 are the parasitic diodes of the first and second FET, respectively. A control circuit 21 receives an input control signal on input I and supplies control signals to control electrodes of the first and the second FET 22, 24. The interconnected main terminals of the first and the second FET 22, 24 are connected to a terminal C. Terminal C is connected to one of the scan electrodes Sc. The yet free main terminal of the first FET 22 is connected to a terminal B, and the yet free main terminal of the second FET 24 is connected to a terminal A.

During the prime period Tp, a first negative voltage (for example: −70 V) is applied to the terminal B, and a second negative voltage (for example: −170 V) is applied to the terminal A. The input control signal applied to the input terminal I determines whether the first FET 22 or the second FET 24 is conductive. If the first FET 22 is conductive, the first negative voltage is supplied to the scan electrode Sc and the associated row is not selected. If the second FET 24 is conductive, the second negative voltage is supplied to the scan electrode Sc and the associated row is selected.

A sub-circuit 20 is connected to every scan electrode Sc to enable priming of the rows R one by one (the cells C associated with the selected row R are preconditioned) by applying appropriate input control signals to respective inputs I of the control circuits 21.

In contrast to the prime period Tp during which the rows R need to be selected one by one, during the sustain period Ts it is advantageous to sustain all rows R at the same time. As no selection per row R is needed, in every sub-circuit 20, the control circuits 21 control the first and the second FET 22, 24 to be non-conductive. So, only the first and second diodes 23, 25 are relevant during the sustain period Ts. During a first period of a sustain pulse Sp, a high positive voltage (for example: +170 V) is applied to terminal A, while terminal B is open ended. A current I1 flows from terminal A via diode 25 to the scan electrode Sc connected to terminal C. During a second period of a sustain pulse Sp, a low voltage (for example: 0 V) is applied to terminal B, while terminal A is open ended. A current I2 flows from terminal C via diode 23 to terminal B.

FIG. 7 shows the connections of sub-circuits 20*i* during a sustain period Ts according to an embodiment of the invention. As discussed earlier, only the first and second diodes 23, 25 are relevant during the sustain period Ts. Therefore, FIG. 7 only shows the first and second diodes 23, 25 of each sub-circuit 20. A sub drive circuit 2*e* comprises the left column of sub-circuits 20*e* with first and second diodes 23*e*, 25*e* to drive the scan electrodes Sce of the even rows Re. A sub drive circuit 20 comprises the right column of sub-circuits 20*o* with first and second diodes 23*o*, 25*o* to drive the scan electrodes Sco of the odd rows Ro. All terminals Ao of the sub-circuits 20*o* in the right column are connected to a first contact 1 of a first switch S1. All terminals Bo of the sub-circuits 20*o* are connected to a second contact 2 of the first switch S1. All terminals Be of the sub-circuits 20*e* in the left column are connected to a first contact 1 of a second switch S2. All terminals Ae of the sub-circuits 20*e* are connected to a second contact 2 of the second switch S2. A common contact of the first switch S1 receives a first voltage V1 from the sustain pulse driver 5. and a common contact of the second switch S2 receives a second voltage V2 from the sustain pulse driver 5. The first voltage V1 is also applied to the even sustain electrodes Sue, via a sub drive circuit 6*e*. The second voltage V2 is also applied to the odd sustain electrodes Suo, via a sub drive circuit 6*o*. As shown, in a preferred embodiment, the sub drive circuits 6*e* and 6*o* are conductors. Both the first and the second switch S1, S2 connect their common contact with contact 1 if the first voltage V1 has a high level (for example: 170 V), and both the first and the second switch S1, S2 connect their common contact with contact 2 if the first voltage V1 has a low value (for example: 0 V). In this way, during the period in time the first voltage V1 has a high voltage and the second voltage V2 has a low value, currents in the odd scan and sustain electrodes Sco, Suo flow from left to right and currents in the even scan and sustain electrodes Sce, Sue flow from right to left, as indicated by the arrows. During the time the first voltage V1 has a low value and the second voltage V2 has a high value, all the currents change direction. Again, the currents in odd and even electrodes Sco, Sce, Suo, Sue flow in opposite directions. The data electrodes D are driven by the data driver 3.

The first and the second switch may be omitted if impedance's of the conductors between the first and the second switch contacts 1, 2 are negligible. In this case the first and the second contact 1, 2 of the first switch S1 may be interconnected to receive the first voltage V1, and the first and the second contact 1, 2 of the second switch S2 may be interconnected to receive the second voltage V2.

While the invention has been described in connection with preferred embodiments, it will be understood that modifications thereof within the principles outlined above will be evident to those skilled in the art and thus the invention is not limited to the preferred embodiments but is intended to en compass such modifications. All values of voltages are examples. The invention is not restricted to a PDP with a certain resolution or a certain number of rows R. It is possible to interchange the row and column directions, the scan and sustain electrodes Sc, Su may extend in the column direction. The invention is also suitable for flat panel displays which are driven in an other mode than a sub field mode. The invention is also not restricted to a PDP in which a different pair of electrodes (one scan and one sustain electrode) Sc, Su are associated to each row R of cells C. With some minor changes it is also possible to generate currents with opposite directions in a PDP in which two rows R of cells C are driven with three electrodes instead of four electrodes. In such a PDP a first row R of cells C is associated to a first scan electrode Sc and a sustain electrode Su, and a second row R of cells is associated to the same sustain electrode Su and a second scan electrode Sc, and so on. The sustain electrodes Su are divided in two groups such that two sustain electrodes Su arranged on either side of a scan electrode Sc belong to different groups. In this way, the priming of only one row R of cells C is possible by applying appropriate voltages to the scan electrode Sc and the adjacent sustain electrodes Su. By further dividing the groups of sustain electrodes Su it is possible to obtain groups of pairs of sustain electrodes Su and scan electrodes Sc, whereby the currents in pairs belonging to different groups flow in opposite directions.

What is claimed is:

1. A flat panel display apparatus comprising:

a flat panel display having a plurality of display elements (C) arranged in a matrix of rows (R) and columns, and first and second electrodes (Sc, Su) being aligned with respect to each other and extending in a row or a column direction, the first and second electrodes (Sc, Su) forming pairs being associated with same display elements (C), and a drive circuit (2, 6) being coupled to the first and second electrodes (Sc, Su) for supplying drive signals to said pairs, characterized in that the drive circuit (2, 6) comprises sub drive circuits (2*o*, 2*e*, 6*o*, 6*e*) for supplying opposite drive signals (V1, V2) to different groups of pairs such that currents flowing in pairs of two different groups flow in opposite direction.

2. A flat panel display apparatus as claimed in claim 1, characterized in that a first one of the sub drive circuits (2*o*) is coupled to a first group of first electrodes (Sco), a second one of the sub drive circuits (2*e*) is coupled to a second group of first electrodes (Sce), a third one of the sub drive circuits (6*o*) is coupled to a first group of second electrodes (Suo), a fourth one of the sub drive circuits (6*e*) is coupled to a second group of second electrodes (Sue), the first group of second electrodes (Suo) being associated with same display elements (C) as corresponding first electrodes (Sco) of the first group of first electrodes, the second group (Sue) of interconnected second electrodes being associated with same display elements (C) as corresponding first electrodes (Sce) of the second group of first electrodes, the first and the fourth sub drive circuit (2*o*, 6*e*) supplying substantially equal first drive signals (V1), the second and third sub drive circuit (2*e*, 6*o*) supplying substantially equal second drive signals (V2), the first drive signal (V1) and the second drive signal (V2) occurring substantially in antiphase.

3. A flat panel display apparatus as claimed in claim 2, characterized in that the third sub drive circuit (6*o*) comprises a conductor interconnecting the first group of second electrodes (Suo), in that the fourth sub drive circuit (6*e*) comprises a conductor interconnecting the second group of second electrodes (Sue).

4. A flat panel display apparatus as claimed in claim 1, characterized in that said pairs of two different groups alternate.

5. A method of driving a flat panel display apparatus, the flat panel display apparatus comprising a flat panel display having a plurality of display elements (C) arranged in a matrix of rows (R) and columns, and first and second electrodes (Sc, Su) being aligned with respect to each other and extending in a row or a column direction, the first and second electrodes (Sc, Su) forming pairs being associated with same display elements (C), and the method comprising the step of driving (2, 6) the first and second electrodes (Sc, Su) by supplying drive signals to said pairs, characterized in that the step of driving (2, 6) comprises the steps of supplying (2*o*, 2*e*, 6*o*, 6*e*) opposite drive signals to different groups of pairs such that currents flowing in pairs of two different groups flow in opposite direction.

* * * * *